US009663949B1

(12) United States Patent
Caste

(10) Patent No.: US 9,663,949 B1
(45) Date of Patent: May 30, 2017

(54) MODULAR SLAT CEILING APPARATUS

(71) Applicant: Timothy K. Caste, Nashville, TN (US)

(72) Inventor: Timothy K. Caste, Nashville, TN (US)

( * ) Notice: Subject to any disclaimer, the term of this patent is extended or adjusted under 35 U.S.C. 154(b) by 0 days.

(21) Appl. No.: 15/149,034

(22) Filed: May 6, 2016

(51) Int. Cl.

| | |
|---|---|
| ***E04B 9/00*** | (2006.01) |
| ***E04B 9/36*** | (2006.01) |
| ***E04B 9/34*** | (2006.01) |
| ***E04B 9/10*** | (2006.01) |
| ***E04B 9/18*** | (2006.01) |

(52) U.S. Cl.
CPC ..... *E04B 9/363* (2013.01); *E04B 9/10* (2013.01); *E04B 9/18* (2013.01); *E04B 9/345* (2013.01)

(58) Field of Classification Search
CPC ..... E04B 9/00; E04B 9/10; E04B 9/18; E04B 9/34; E04B 9/345
See application file for complete search history.

(56) References Cited

U.S. PATENT DOCUMENTS

| | | | | |
|---|---|---|---|---|
| 2,689,026 | A | 9/1954 | Zingone | |
| 2,706,314 | A * | 4/1955 | Siering | E04B 9/34 52/145 |
| 2,842,811 | A | 7/1958 | Weeks | |
| 3,035,672 | A * | 5/1962 | Tuten | E04B 9/04 52/506.07 |
| 3,370,301 | A * | 2/1968 | Harlan | E04B 9/068 52/664 |
| 3,418,766 | A | 12/1968 | Jackson | |
| 4,034,534 | A | 7/1977 | Taylor | |
| 4,328,653 | A | 5/1982 | Anderle | |
| 4,463,536 | A | 8/1984 | Anderle et al. | |
| 4,532,749 | A | 8/1985 | Perk | |
| 4,665,674 | A | 5/1987 | Brugman | |
| 6,192,642 | B1 * | 2/2001 | Colson | E04B 9/00 52/506.01 |
| 6,427,409 | B2 | 8/2002 | Colson et al. | |
| 7,278,243 | B2 * | 10/2007 | Jones | E04B 9/068 52/287.1 |
| 7,779,593 | B2 * | 8/2010 | Jahn | E04B 9/067 52/220.6 |
| 2013/0192772 | A1 | 8/2013 | Damen et al. | |

FOREIGN PATENT DOCUMENTS

| | | |
|---|---|---|
| EP | 0226556 A2 | 6/1987 |

* cited by examiner

*Primary Examiner* — Beth Stephan
(74) *Attorney, Agent, or Firm* — Waller Lansden Dortch & Davis LLP; Matthew C. Cox

(57) ABSTRACT

A slat ceiling apparatus includes a frame and a plurality of slats spanning the frame. The frame includes first and second frame members, each having an inner side and an outer side. A plurality of slots are defined in the inner side of each frame member. Each slat includes first and second longitudinal ends. The first longitudinal end is positioned in a slot on the first frame member, and the second longitudinal end is positioned in a slot on the second frame member. A plurality of slats are arranged spanning the first and second frame members, each having longitudinal ends received in corresponding slots on the first and second frame members. The slats are arranged in a substantially parallel orientation in some embodiments, and a gap is provided between each slat.

11 Claims, 9 Drawing Sheets

MODULAR SLAT CEILING APPARATUS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND

The present disclosure relates to ceiling materials and more particularly to louvered ceilings having multiple slats.

Conventional ceilings in residential and commercial spaces such as homes, restaurants, offices, stores, rec rooms, and other buildings typically include an interior ceiling and floor. Ceilings are usually covered with an intermediate fascia or material below the ceiling structure. For example, ceiling tiles are often suspended below a ceiling structure from a hanging frame in many conventional drop ceilings. The frame may be suspended from the ceiling using one or more anchors and wires dropping down from the ceiling. Conventional ceiling frame and tile configurations are common in many commercial spaces. In such systems, a space or gap is provided between the uppermost ceiling and the suspended ceiling frame and tiles. Mechanical items such as plumbing, wiring raceways, hvac equipment, communications equipment or other devices may be positioned between the uppermost ceiling and the suspended ceiling components. As such, the mechanical items are typically not visible to people positioned in the space below the ceiling fixture.

In many applications, it is desirable to provide ceiling materials having a decorative or aesthetic appearance. One style of ceiling arrangements includes a plurality of parallel rigid boards or slats attached to the ceiling with spaces between them, creating a louvered appearance. These types of ceiling fixtures commonly include wooden or plastic boards spanning a portion of the ceiling, and they provide decorative finishing for use in interior spaces. Conventional slatted, or louvered, ceiling arrangements typically include boards or slats nailed or otherwise fixed into the walls of the room. The slats, or louvers, are positioned below the uppermost ceiling to provide a gap similar to the space provided between an uppermost ceiling and ceiling tiles in conventional drop ceiling arrangements.

One problem with conventional slatted ceiling arrangements is the lack of modularity associated with the installed arrangement. For example, once slats are nailed or otherwise fixed in place in conventional louvered ceiling arrangements, the slats are difficult to move without damaging the walls or other interior surfaces. This makes it difficult to access the space above the slats for accessing the mechanical, electrical or other hardware routed through the gap between the uppermost ceiling and the slates.

Another problem with conventional slatted ceiling arrangements is the permanent configuration provided when the slats are nailed or otherwise fastened to the wall. Once the slats are positioned, it is difficult to remove the slats to achieve a different slat orientation.

Yet another problem with conventional slatted ceiling arrangements is cost and expense associated with installation. Conventional arrangements require custom measurement and installation of each slat. These installations typically require a carpenter to ensure the slats are properly measured, aligned and installed. If any single slat is not parallel with the other slats, the appearance of the installation is diminished.

What is needed, then are improvements in devices and methods for providing slatted, or louvered, ceilings.

BRIEF SUMMARY

The present disclosure provides a ceiling slat apparatus that may be installed in interior or exterior spaces to provide a decorative ceiling. The apparatus may be installed in interior spaces such as offices, homes, stores, recreation areas, restaurants and many other interior rooms in buildings. The apparatus may also be installed in some exterior spaces such as decks, porches, or other covered spaces where a decorative ceiling is desired.

The ceiling slat apparatus in some embodiments includes a frame and a plurality of modular slats spanning the frame. The frame includes a plurality of frame members around the perimeter of the frame. Each frame member includes an outer side and an inner side. A gap is defined between the outer side and inner side of the frame. Multiple slots are defined in the inner side of the frame, and each slot is positioned to receive a longitudinal end of an upright slat. A plurality of slats span the frame, and each longitudinal end of each slat is received in a corresponding slot on a frame member. The slats are arranged in a substantially parallel configuration, with a space between adjacent slats in some embodiments.

In some configurations, the present disclosure provides a ceiling apparatus including a frame support that may be suspended from an upper ceiling structure. The frame support provides a mounting surface on which frame members may be mounted on the interior side of the frame support. A plurality of slats are positioned in the frame support spanning the frame members. Multiple frame supports may be positioned adjacent one another to provide a ceiling for an interior space.

Some aspects of the present disclosure include a ceiling frame and a plurality of slats spanning the frame. In some embodiments, the slats are substantially parallel and are arranged upright on their side. A gap is defined between adjacent slats. The frame includes a frame slot that receives the longitudinal ends of each upright slat.

Numerous other objects, advantages and features of the present disclosure will be readily apparent to those of skill in the art upon a review of the following drawings and description of a preferred embodiment.

DETAILED DESCRIPTION

Figure 1:
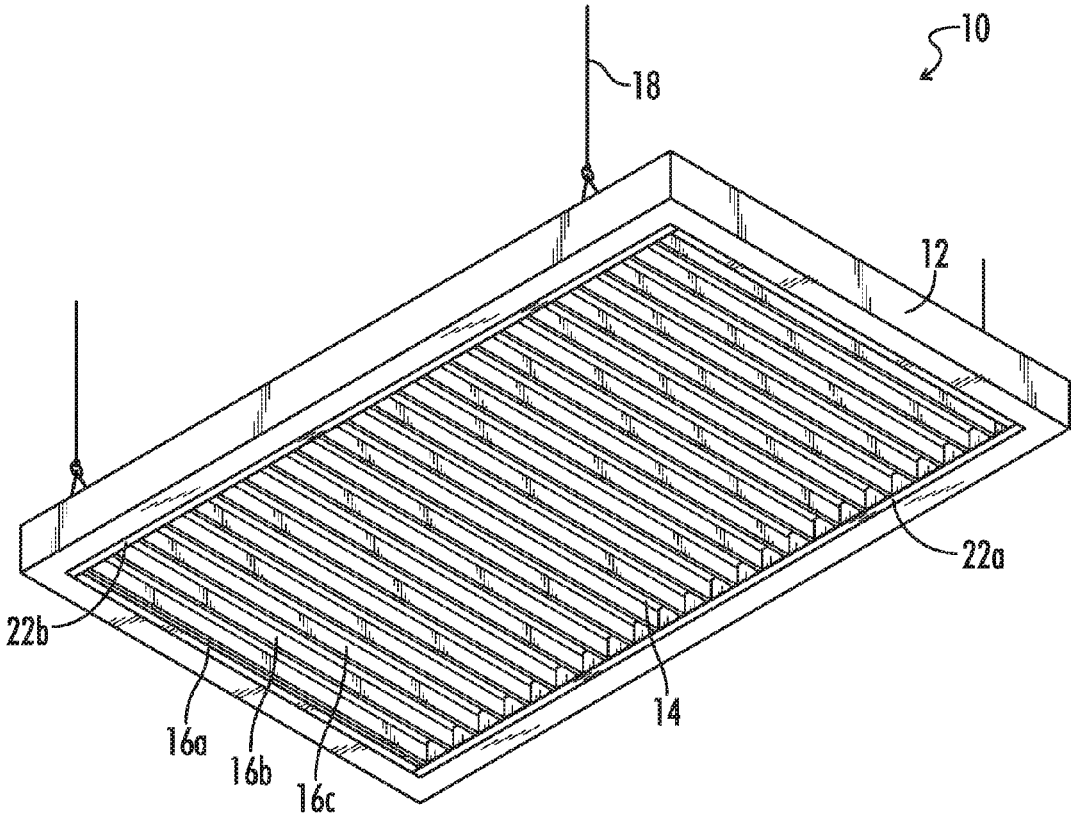
FIG. 1 illustrates a perspective view of an embodiment of ceiling slat apparatus in accordance with the present disclosure.

Referring now to the drawings, FIG. 1 illustrates a perspective view of one embodiment of a reciprocating tool attachment including a reciprocating tool attachment apparatus generally designated by the numeral 10. In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

As shown in FIG. 1, a slat ceiling apparatus 10 includes a frame 12 and a plurality of slats 16*a*, 16*b*, 16*c*, etc. spanning the frame. Each slat 16 includes a rigid member such as a board or longitudinal length of material. Apparatus 10 may be suspended from an upper ceiling using one or more hangers 18 in some embodiments. A gap, or opening 14 is formed between adjacent slats 16, as seen in FIG. 1. The slats 16 provide a decorative ceiling arrangement for use in interior or exterior spaces where a decorative ceiling is desired.

Figure 2:
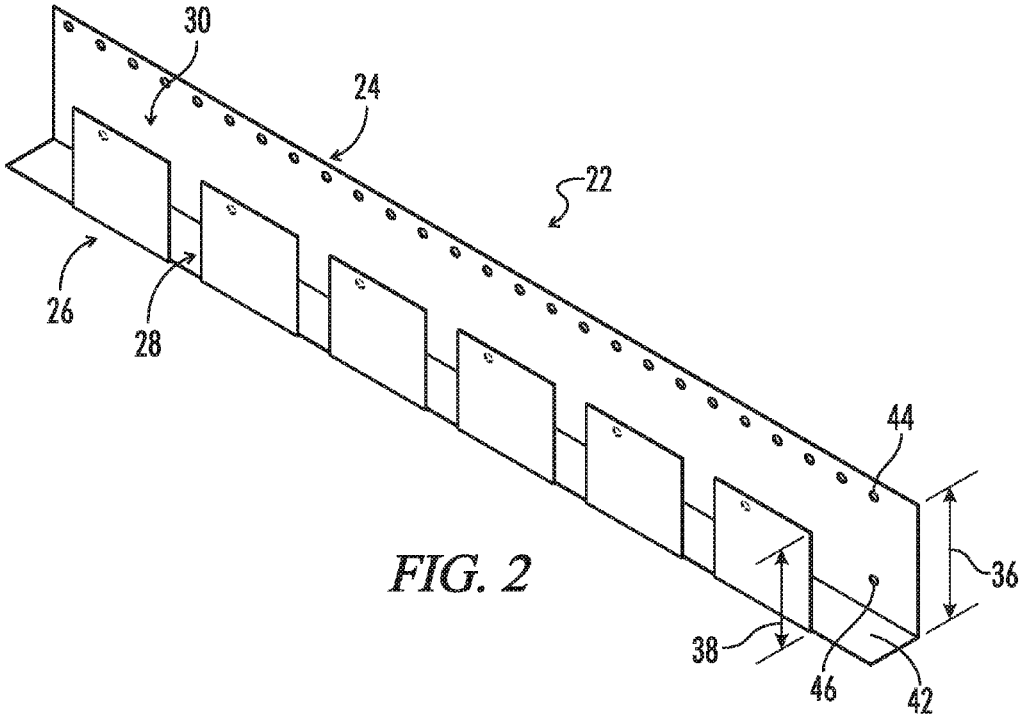
FIG. 2 illustrates a perspective view of an embodiment of a frame member for a ceiling slat apparatus in accordance with the present disclosure.

Apparatus 10 includes a first frame member 22*a* and a second frame member 22*b* in some embodiments. First and second frame members 22*a*, 22*b* are positioned in spaced relation such that a plurality of slats may span between the first and second frame members 22*a*, 22*b*. As seen in FIG. 2, each frame member 22 includes an outer frame side 24 and an inner frame side 26. For example, first frame member 22*a* includes a first frame member outer frame side 24 and a first frame member inner frame side 26. Second frame member 22*b* also includes a second frame member outer frame side 24 and a second frame member inner frame side 26.

A frame base 42 is positioned between the outer frame side 24 and the inner frame side 26. The frame base 42 provides lateral separation between the outer and inner frame sides, forming a frame gap 30 between the outer frame side 24 and the inner frame side 26.

Figure 3:
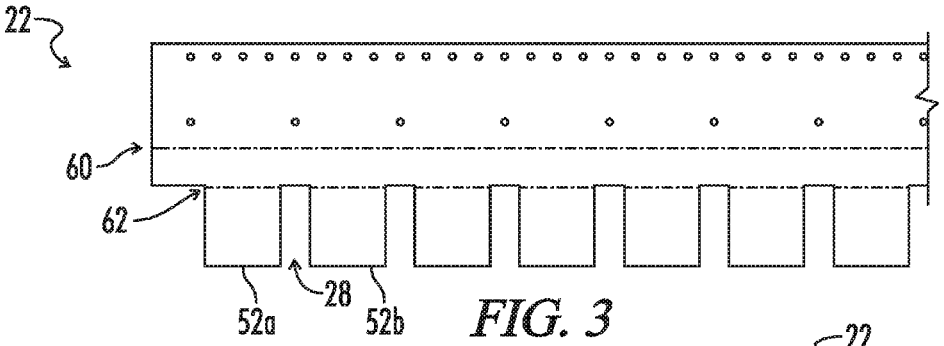
FIG. 3 illustrates a plan view of a frame member for a ceiling slat apparatus prior to bending in accordance with the present disclosure.

Frame member 22 in some embodiments is formed from a bent piece of metal in some embodiments. For example, as seen in FIG. 3, frame member 22 is formed from a flat piece of material that may be stamped or cut to shape. A first bend 60 forms a longitudinal intersection between outer frame side 24 and frame base 42, and a second bend 62 forms a longitudinal intersection between inner frame side 26 and frame base 42. In other embodiments, frame member 22 may be formed by extruding a material such as metal to form a desired U-shaped frame member.

As seen in FIG. 3, in some embodiments, frame member 22 includes a plurality of upright tabs 52*a*, 52*b*, etc. extending from the frame base 42. Each tab is separated by a slot 28. Each slot 28 is defined in the inner frame side 26, forming a recess shaped to receive a longitudinal end of a slat 16. In some embodiments, frame member 22 includes a plurality of lower holes 46 defined in the outer frame side 24. Each lower hole 46 is longitudinally aligned with a slot 28, allowing passage of a tool through the slot 28 to access the fastener across the frame gap 30. Each lower hole 46 is positioned below the upper holes 44.

Figure 5:
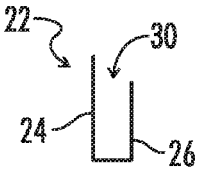
FIG. 5 illustrates an end view of the embodiment of a frame member of FIG. 2 in accordance with the present disclosure.
Figure 4:
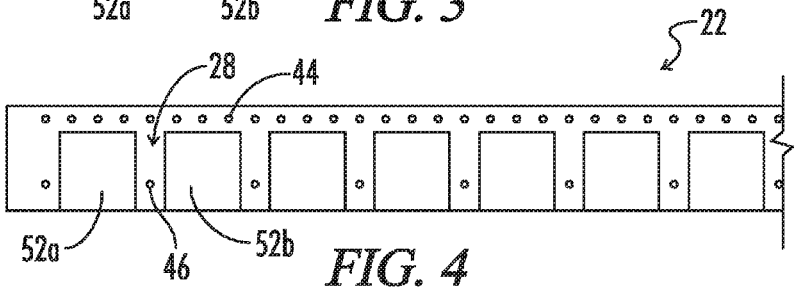
FIG. 4 illustrates a front view of the embodiment of a frame member of FIG. 2 in accordance with the present disclosure.

Referring further to FIG. 2, outer frame side 24 includes an outer frame height 36, and inner frame side 26 includes an inner frame height 38. In some embodiments, outer frame height 36 is greater than inner frame height 38. This configuration can also be seen in an end view of frame member 22 in FIG. 5. Inner frame height 38 is substantially equal to the height of slats 16 in some embodiments. By providing an outer frame height 36 that is greater than inner frame height 38, a space may be provided above the slats when installed. The space above the slats facilitates the removal of one or more slats by pushing it upwardly and/or rotating the slat onto its side in the space above the slats. Additionally, by providing an outer frame height 36 greater than inner frame height 38, upper holes 44 may be accessed by tools for installing or removing fasteners without being blocked by inner frame side 26.

Each frame member 22 forms a longitudinal bracket that supports the longitudinal ends of multiple slats. Frame member 22 includes a plurality of upper holes 44 defined on the outer frame side 24 The upper holes 44 provide holes for passing fasteners to secure the frame member 22 to a surface such as a wall or frame support. During installation, each frame member 22 is attached to a surface using one or more fasteners.

Figure 6:
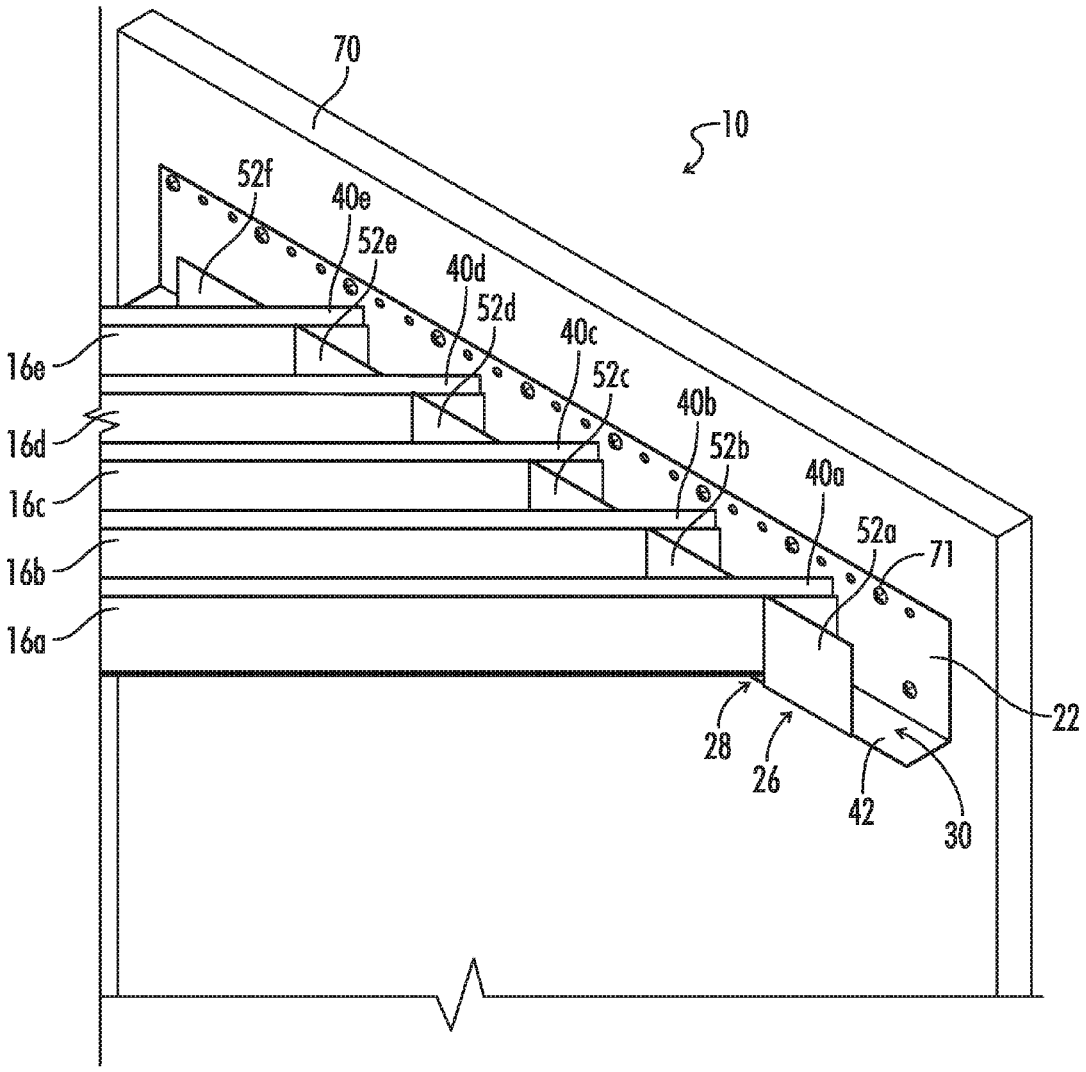
FIG. 6 illustrates a perspective view of an embodiment of a ceiling slat apparatus installed on a wall.

Referring now to FIG. 6, in some embodiments, frame member 22 is mounted to a surface such as a wall 70. Frame member 22 is mounted at the desired height for the slat ceiling. Frame member 22 may be fastened to wall 70 using one or more fasteners 71 passing through upper and lower holes 44, 46. A plurality of slats 16*a*, 16*b*, 16*c*, 16*d*, 16*e*, etc. are positioned in spaced relation, and each slat includes a first longitudinal end 40*a*, 40*b*, 40*c*, 40*d*, 40*e*, etc. Each longitudinal end 40 is received in a corresponding slot 28 on inner frame side 26. Each longitudinal end 40 is received in frame gap 30 between inner side 26 and outer side 24. Each longitudinal end 40 may rest against frame base 42 in some embodiments. In other embodiments, each longitudinal end 40 rests against a portion of inner side 26 that extends above frame base 42. As seen in FIG. 6, inner side 26 includes a plurality of tabs 52*a*, 52*b*, 52*c*, 52*d*, 52*e*, 52*f*, etc. rising from frame base 42. Each tab 52*a*, 52*b*, 52*c*, 52*d*, 52*e*, 52*f*, etc. separates adjacent slats 16. The spacing between adjacent slats 16 is determined by the longitudinal dimension of each tab 52*a*, 52*b*, 52*c*, 52*d*, 52*e*, 52*f*, etc. in some embodiments.

The slats 16 may be mounted on each frame member in any suitable angular orientation. As seen in FIG. 6, slats 16 are oriented at an angle relative to the longitudinal orientation of frame member 22. In other embodiments, slats 16 may be oriented perpendicularly relative to the longitudinal orientation of frame member 22.

Each frame member 22*a*, 22*b*, 22*c*, 22*d* may include separate pieces in some embodiments. In other embodiments, the frame members may be formed from a single piece of sheet metal and bent in such a way as to form multiple frame members.

Figure 7:
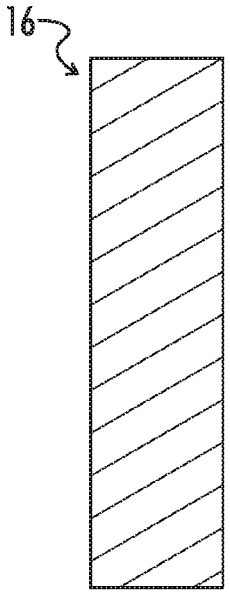
FIG. 7 illustrates an end view of an embodiment of a slat in accordance with the present disclosure.
Figure 8:
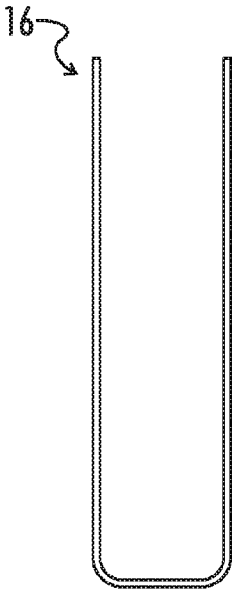
FIG. 8 illustrates an end view of an embodiment of a slat in accordance with the present disclosure.
Figure 9:
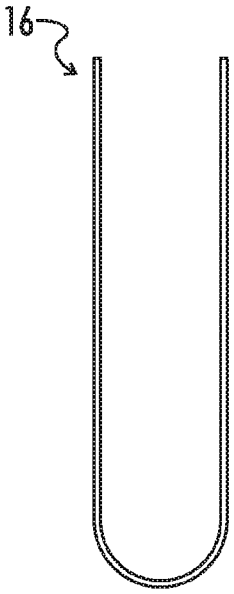
FIG. 9 illustrates an end view of an embodiment of a slat in accordance with the present disclosure.
Figure 10:
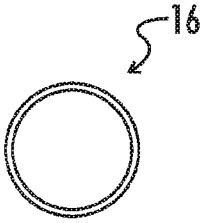
FIG. 10 illustrates an end view of an embodiment of a slat in accordance with the present disclosure.

Slats 16 can include any suitable member for spanning frame members 22. For example, as seen in FIG. 7, slat 16 includes a substantially solid material body in some embodiments. Slat 16 can include a rectangular, polygonal, or curvilinear cross-sectional profile. As seen in FIG. 8, slat 16 forms a U-shaped member having slightly rounded lower corners. As seen in FIG. 9, slat 16 forms a U-shaped member having a fully-rounded lower edge. As seen in FIG. 10, in some embodiments, slat 16 has hollow cross-sectional profile. Slat 16 in some embodiments includes a hollow rod, having a rectangular, polygonal, or curvilinear cross-sectional profile. As seen in FIG. 10, slat 16 includes a substantially circular cross-sectional profile.

Figure 11:
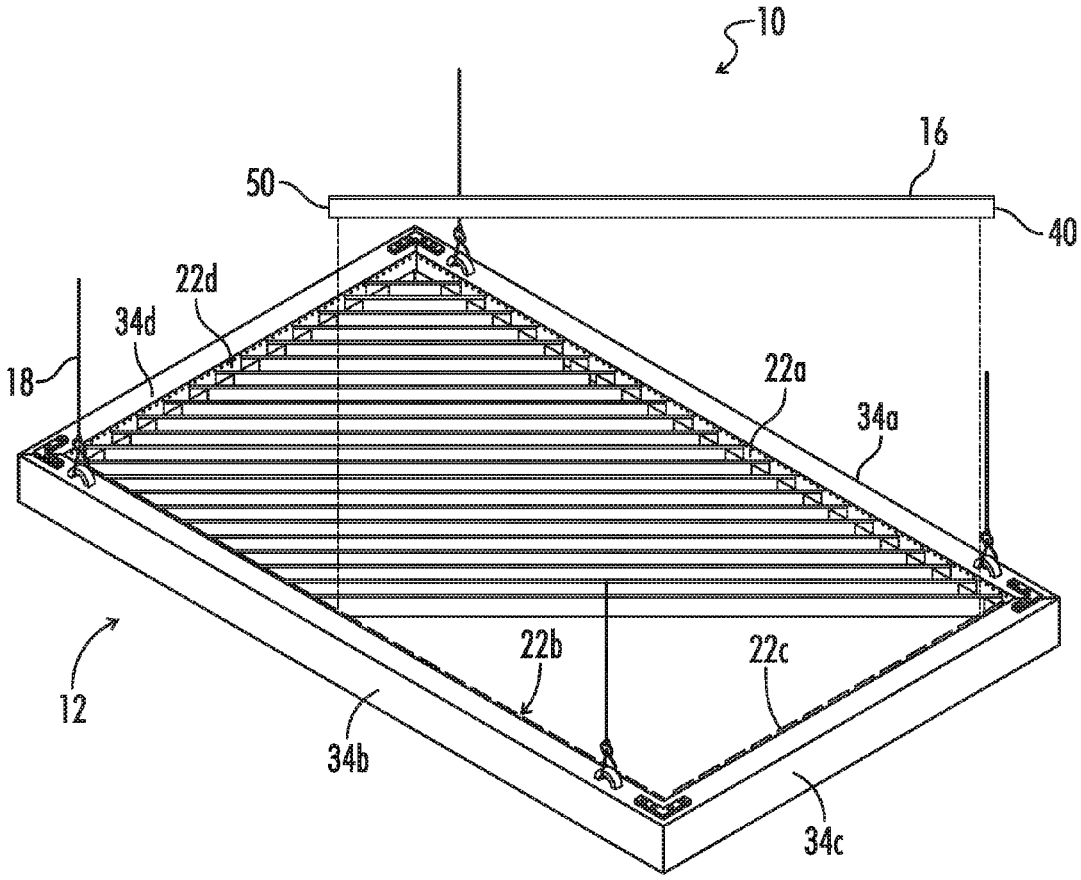
FIG. 11 illustrates a partially exploded perspective view of an embodiment of a ceiling slat apparatus in accordance with the present disclosure.

Referring now to FIG. 11, slats 16 are generally loaded into frame members 22 from above. Each slat 16 includes a first longitudinal end 40 and a second longitudinal end 50. Each longitudinal end is received in a corresponding slot on a frame member 22. In some embodiments, slats 16 are held in place in slots 28 on frame members 22 by gravity, and no additional fasteners are required to secure slats 16 to the frame members 22.

As seen in FIG. 11, in some embodiments, apparatus 10 includes a frame support 12 forming a perimeter. Frame support 12 can include a box-shaped support structure in some embodiments. Frame support 12 can be suspended from an overhead ceiling structure, or other overhead support, using one or more hangers 18. A plurality of frame members 22*a*, 22*b*, 22*c*, 22*d*, etc. are installed on frame support 12. First frame member 22*a* is installed on a first support side 34*a*, and second frame member 22*b* is installed on a second support side 34*b* opposite first support side 34*a*. A third frame member 22*c* is installed on a third support side 34*c*, and a fourth frame member 22*d* is installed on a fourth support side 34*d*. In some embodiments, slats 16 are positioned diagonally such that some slats span from adjacent frame members. For example, as seen in FIG. 11, some slats 16 span from first frame member 22*a* to fourth frame member 22*d*. Other slats in the same configuration span from first frame member 22*a* to second frame member 22*b*. Still other slats in the same configuration span from second frame member 22*b* to third frame member 22*c*.

Figure 12:
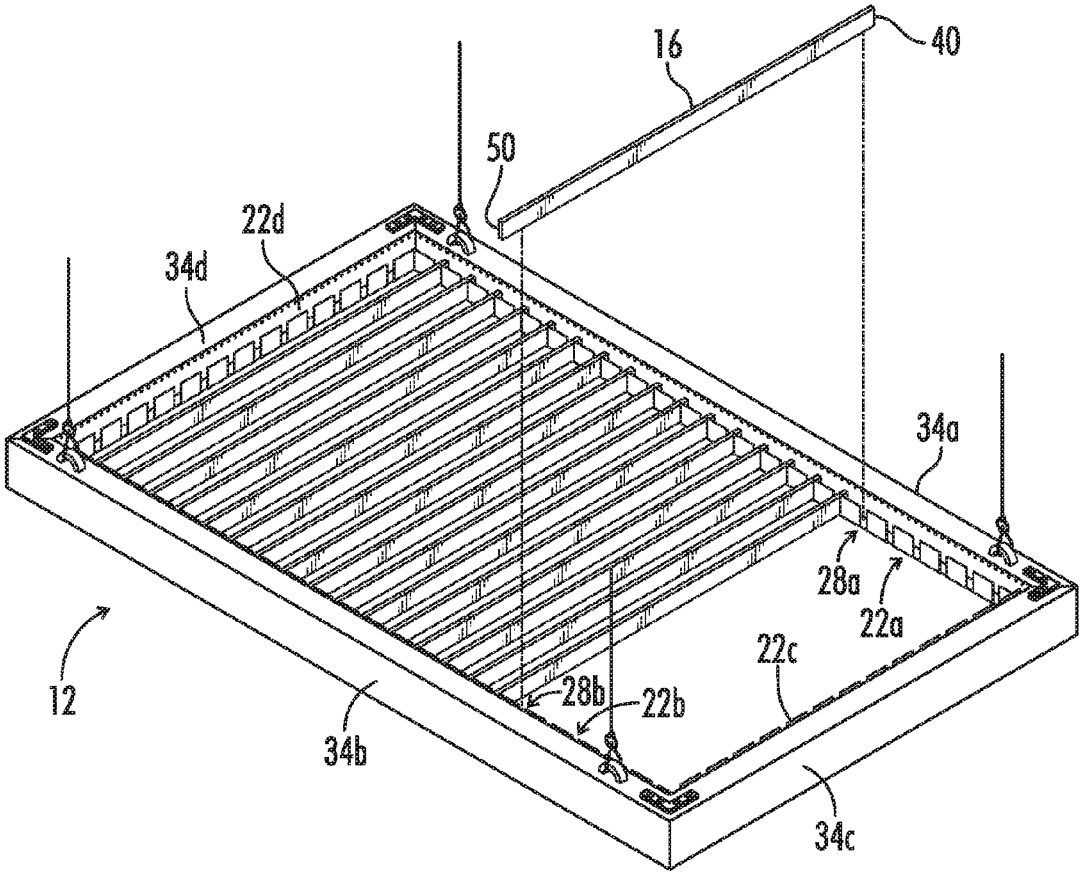
FIG. 12 illustrates a partially exploded perspective view of an embodiment of a ceiling slat apparatus in accordance with the present disclosure.

One benefit of the apparatus 10 is that frame support 12 together with its installed frame members 22 can be used with multiple slat orientations. As seen in FIG. 12, a similar frame support 12 includes slats 16 arranged in a substantially parallel configuration, wherein each slat includes a first longitudinal end 40 mounted in a corresponding slot 28*a* on first frame member 22*a* and a second longitudinal end 50 mounted in a corresponding slot 28*b* on second frame member 22*b*. In this configuration, only the first and second frame members 22*a*, 22*b* are utilized for mounting slats 16. Also, in this configuration, each slat 16 includes substantially the same longitudinal length.

Figure 13:
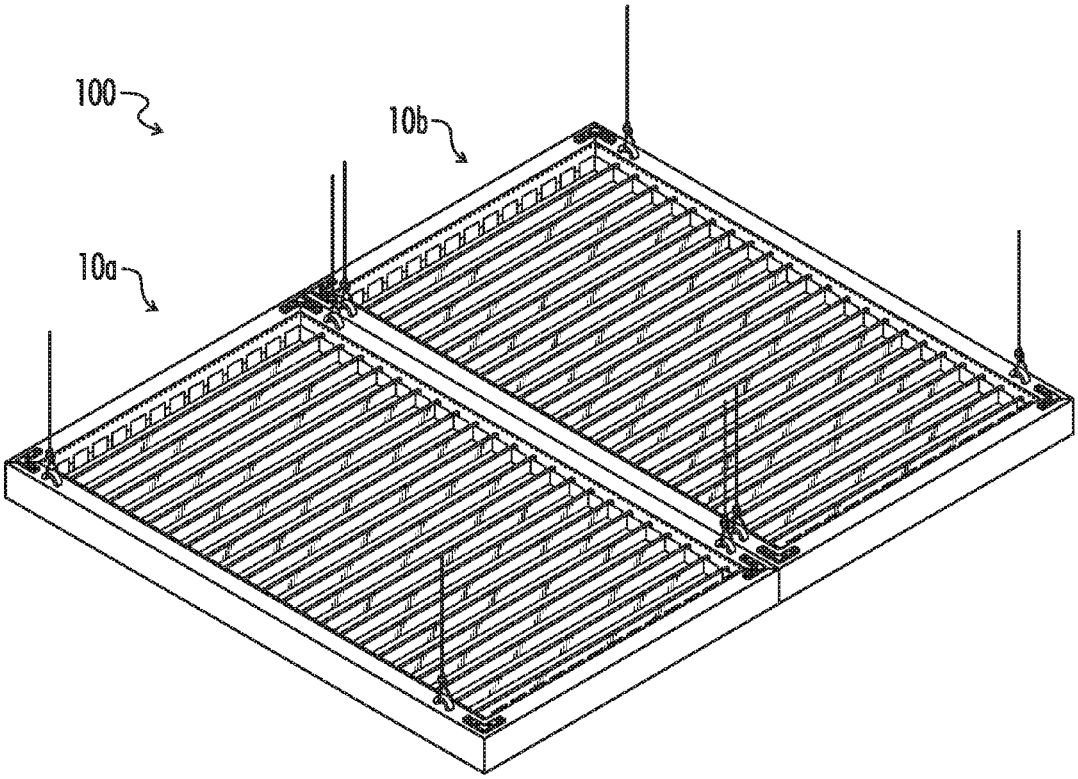
FIG. 13 illustrates a perspective view of an embodiment of an assembly of two ceiling slat apparatuses in accordance with the present disclosure.

Referring now to FIG. 13, in some embodiments, the present disclosure provides a slat ceiling assembly 100 including a first slat ceiling apparatus 10*a* and a second slat ceiling apparatus 10*b*. Each slat ceiling apparatus includes first and second frame members having slots for receiving longitudinal ends of slats. Each slat ceiling apparatus also includes a plurality of slats having longitudinal ends positioned in corresponding slots defined in the frame members. An array of slat ceiling apparatuses may be used to cover an entire ceiling area in a room.

Figure 14:
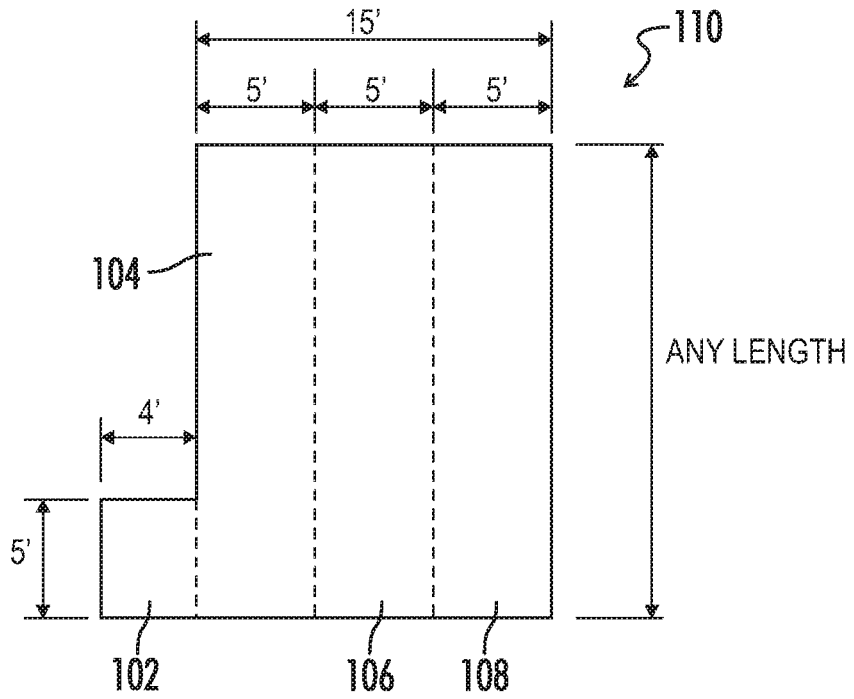
FIG. 14 illustrates a plan view of an embodiment of a room configuration for an installation of a ceiling slat apparatus in accordance with the present disclosure.
Figure 16:
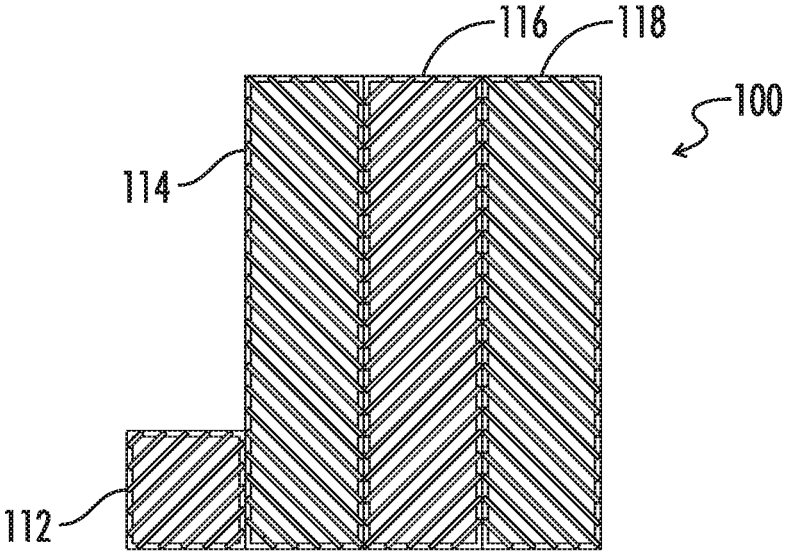
FIG. 16 illustrates a plan view of an embodiment of an assembly of ceiling slat apparatuses positioned to cover a ceiling in accordance with the present disclosure.

Referring to FIG. 14 and FIG. 16, a ceiling layout 110 may include an irregular shape. In some embodiments, as seen in FIG. 14, ceiling layout 110 may be subdivided into a plurality of sub-areas 102, 104, 106, 108. Each sub-area may be covered by a slat ceiling apparatus as seen in FIG. 16. For example, first sub-area 102 is covered by a first slat ceiling apparatus 112, second sub-area 104 is covered by a second slat ceiling apparatus 114, third sub-area 106 is covered by a third slat ceiling apparatus 116, fourth sub-area 108 is covered by a fourth slat ceiling apparatus 118.

Figure 15:
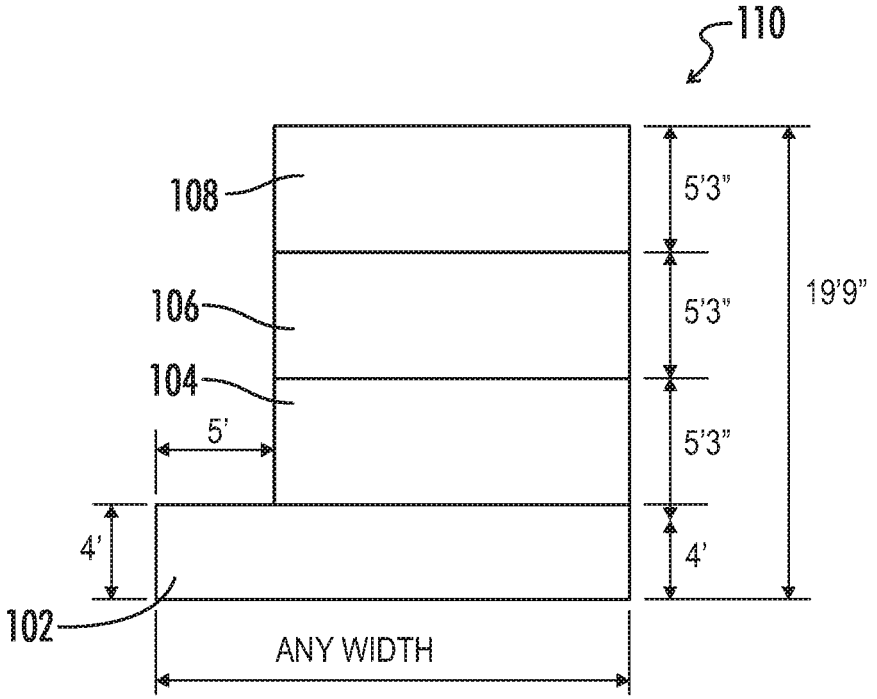
FIG. 15 illustrates a plan view of an embodiment of a room configuration for an installation of a ceiling slat apparatus in accordance with the present disclosure.
Figure 17:
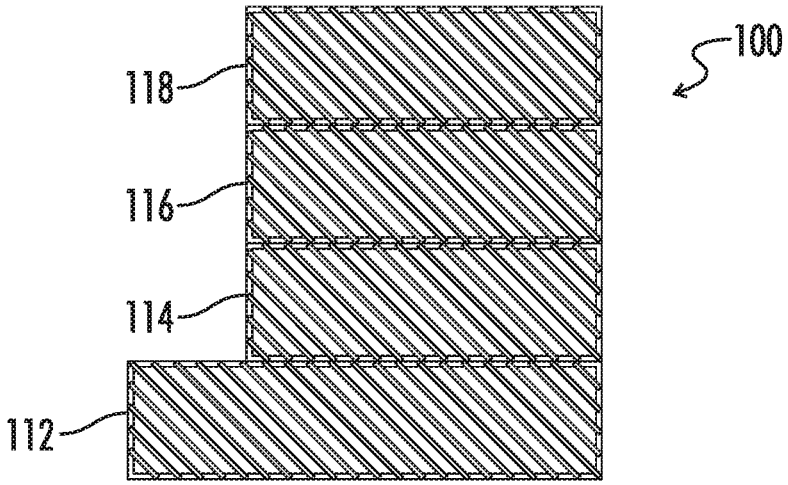
FIG. 17 illustrates a plan view of an embodiment of an assembly of ceiling slat apparatus positioned to cover a ceiling in accordance with the present disclosure.

As seen in FIG. 15, a similar ceiling layout 110 may be subdivided into different sub-areas 102, 104, 106, 108. Each sub-area may be covered by a slat ceiling apparatus as seen in FIG. 17. For example, first sub-area 102 is covered by a first slat ceiling apparatus 112, second sub-area 104 is covered by a second slat ceiling apparatus 114, third sub-area 106 is covered by a third slat ceiling apparatus 116, fourth sub-area 108 is covered by a fourth slat ceiling apparatus 118. The dimensions provided in FIG. 14 and FIG. 15 are provided merely as an example, and are not intended to be limiting on the scope of the invention. The slat ceiling apparatus and the slat ceiling assembly of the present invention may be configured in any suitable dimensional range corresponding to an overhead ceiling or a section of an overhead ceiling.

Figure 18:
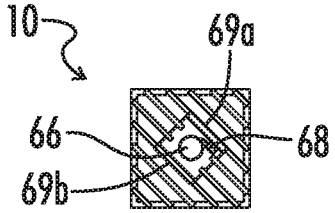
FIG. 18 illustrates an embodiment of a lighting insert for use in a ceiling apparatus in accordance with the present disclosure.
Figure 19:
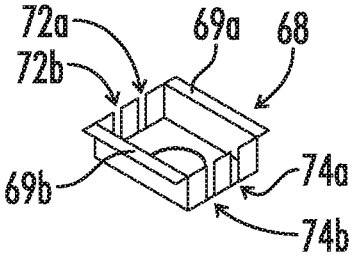
FIG. 19 illustrates a light insert bracket for use in a ceiling apparatus in accordance with the present disclosure.

Referring further to the drawings, in some embodiments, it may be desirable to include one or more lights, such as a can light, in the slat ceiling apparatus. As shown in FIG. 18, a light insert 68 may be disposed in slat ceiling apparatus 10. Light insert 68 includes a light emitter 66 such as an LED or incandescent light. Light insert 68 includes a bracket for installation in a slat ceiling apparatus, as shown in FIG. 19. Light insert 68 includes opposing flanges 69*a*, 69*b* that may rest against the upper edge of two slats. The flanges do not necessarily have to rest against adjacent slats. Light insert 68 may drop down between slats to provide a flush mount with the underside of the slat ceiling apparatus. Light insert 68 includes one or more side slots 72*a*, 72*b* on a first side of the light frame for accepting longitudinal ends of slats on the first side, and one or more side slots 74*a*, 74*b* on a second side of the light frame positioned to accept longitudinal ends of slats on the second side. The side slots receive longitudinal ends of shorter slats when the light insert 68 spans more than two slats on the apparatus.

Thus, although there have been described particular embodiments of the present invention of a new and useful SLAT CEILING APPARATUS, it is not intended that such references be construed as limitations upon the scope of this invention.

What is claimed is:

1. A slat ceiling apparatus, comprising:

a first frame member and a second frame member;

the first frame member including a first frame member base, a first frame member outer side extending upwardly from the first frame member base and a first frame member inner side comprising a plurality of upwardly extending tabs each extending upwardly from the first frame member base and having a first frame member inner side height, and a first frame gap defined between the first frame member inner side and the first frame member outer side;

the first frame member includinq a first frame member outer side height greater than the first frame member inner side height;

the second frame member including a second frame member base, a second frame member outer side extending upwardly from the second frame member base and a second frame member inner side comprising a plurality of upwardly extending tabs each extending upwardly from the second frame member base and having a second frame member inner side height, and a second frame gap defined between the second frame member inner side and the second frame member outer side;

a plurality of first slots defined in the first frame member inner side between the first frame member tabs;

a second slot defined in the second frame member inner side; and a first slat having a first longitudinal end and a second longitudinal end opposite the first longitudinal end, the first slat spanning between the first and second frame members, wherein the first longitudinal end is received in one of the plurality of first slots, and the second longitudinal end is received in slot.

2. The apparatus of claim 1, further comprising the second frame member including a second frame member inner side height and a second frame member outer side height greater than the second frame member inner side height.

3. The apparatus of claim 2, further comprising a plurality of upper holes positioned to receive one or more fasteners defined on the first frame member outer side.

4. The apparatus of claim 3, further comprising a plurality of lower holes positioned to receive one or more fasteners defined on the first frame member below the upper holes.

5. The apparatus of claim 4, wherein at least one of the lower holes is longitudinally aligned with one of the plurality of first slots.

6. The apparatus of claim 5, wherein the slat comprises a solid member.

7. The apparatus of claim 6, wherein the slat includes a slat width and a slat height greater than the slat width.

8. The apparatus of claim 5, wherein the slat comprises a U-shaped member.

9. The apparatus of claim 8, wherein the slat includes a slat width and a slat height greater than the slat width.

10. The apparatus of claim 5, wherein the slat comprises a substantially circular cross-sectional shape.

11. The apparatus of claim 10, wherein the slat is substantially hollow.

* * * * *